US008198832B2

(12) United States Patent
Bai et al.

(10) Patent No.: US 8,198,832 B2
(45) Date of Patent: Jun. 12, 2012

(54) METHOD AND SYSTEM FOR EXTENDING PWM DIMMING RANGE IN LED DRIVERS

(75) Inventors: Hua Bai, San Jose, CA (US); Dongyan Zhou, Santa Clara, CA (US)

(73) Assignee: Linear Technology Corporation, Milpitas, CA (US)

( * ) Notice: Subject to any disclaimer, the term of this patent is extended or adjusted under 35 U.S.C. 154(b) by 176 days.

(21) Appl. No.: 12/856,159

(22) Filed: Aug. 13, 2010

(65) Prior Publication Data

US 2012/0038288 A1 Feb. 16, 2012

(51) Int. Cl.
*G05F 1/00* (2006.01)

(52) U.S. Cl. ..... 315/307; 315/308; 315/291; 315/247; 315/224

(58) Field of Classification Search ..... 315/307, 315/291, 308, 312, 314, 309, 29, 324; 345/204, 345/212, 214, 82, 83, 84
See application file for complete search history.

(56) References Cited

U.S. PATENT DOCUMENTS

| | | | | |
|---|---|---|---|---|
| 5,305,192 | A | 4/1994 | Bonte et al. | |
| 5,438,499 | A | 8/1995 | Bonte et al. | |
| 7,088,319 | B2 * | 8/2006 | Yoshida et al. | 345/82 |
| 7,286,123 | B2 * | 10/2007 | Yang | 345/204 |
| 7,688,009 | B2 * | 3/2010 | Bayadroun | 315/360 |
| 2002/0105487 | A1 | 8/2002 | Inoue | |
| 2003/0071586 | A1 * | 4/2003 | Lin et al. | 315/291 |
| 2003/0111969 | A1 * | 6/2003 | Konishi et al. | 315/291 |

FOREIGN PATENT DOCUMENTS

| | | |
|---|---|---|
| GB | 2 454 557 A | 5/2009 |
| WO | WO 2009/157763 A | 12/2009 |

OTHER PUBLICATIONS

Extended European Search Report issued in European Patent Application No. EP 11006618.0 dated Nov. 23, 2011.

* cited by examiner

*Primary Examiner* — Shawki S Ismail
*Assistant Examiner* — Christopher Lo
(74) *Attorney, Agent, or Firm* — McDermott Will & Emery LLP

(57) ABSTRACT

An apparatus for driving a light emitting diode (LED). A rising edge of a pulse width modulation (PWM) signal is first sensed. Upon sensing the rising edge, a threshold pulse (TP) signal is initiated that has a configured width started when the rising edge is sensed, an LED current with an amplitude at a previously set level is generated, and starting to charge a capacitor which yields a voltage Vcap. Subsequently, a falling edge of either the PWM signal or the TP signal is detected. Upon detecting the failing edge, the circuit stops charging the capacitor, samples, after a first delay from the detected falling edge, the voltage Vcap, and adjusts a level of the amplitude of the LED current based on the sampled voltage Vcap. When the falling edges of both the PWM and TP signal are detected, the LED current is terminated.

18 Claims, 6 Drawing Sheets

300

| 310 PWM signal | 320 TP signal | 330 Voltage for analog dimming control |
|---|---|---|
| 1 | 1 | 340 Previous measurement |
| 1 | 0 ↓ | 350 Vcap measured at falling edge of threshold pulse |
| 0 ↓ | 1 | 360 Vcap measured at falling edge of the PWM |
| 0 | 0 | 370 Terminate the dimming |

Fig. 3

500

| 505 PWM Voltage | 510 PWM Width | 515 Threshold Pulse Width | 520 Control Voltage | 525 LED Current Amplitude | 530 LED Current Width |
|---|---|---|---|---|---|
| 2.5 V | 30 µs | 10 µs | 1.0 v | 500 mA | 30 µs (540) |
| 2.5 V | 5 µs | 10 µs | 0.5 v | 250 mA | 10 µs (545) |
| 2.5 V | 2 µs | 10 µs | 0.2 v | 100 mA | 10 µs (550) |
| 1.5 V | 30 µs | 10 µs | 0.5 v | 250 mA | 30 µs (555) |

Fig. 5

METHOD AND SYSTEM FOR EXTENDING PWM DIMMING RANGE IN LED DRIVERS

BACKGROUND

1. Technical Field

The present teaching relates to method and system for light emitting diodes (LED). More specifically, the present teaching relates to method and system for LED dimming and systems incorporating the same.

2. Discussion of Technical Background

LED lighting has been widely utilized in different application scenarios. To save energy and cost, dimming technologies have also been developed so that the lighting can be dimmed in different situations. Traditionally, there are different categories of dimming methods, including pulsed width modulation (PWM) dimming and analog dimming. In PWM dimming, the amount of the LED current used for driving the LED light is usually determined based on the pulse width and period of a PWM signal while in analog dimming, the amount of LED current used to drive the LED light is conventionally determined based on the amplitude of an analog signal. In some applications, PWM dimming and analog dimming can be applied to control the LED current but as separate optional choices. That is, one pin of the LED dimming control may be used to supply a PWM signal for PWM dimming control and another pin may be separately provided so that an analog signal may be individually supplied for analog dimming purposes. A user may be provided with a means to select one or the other approach to control the LED dimming. Although the user has a choice of either dimming approach, traditionally at any given time, only one method is elected so that the other pin may not be utilized. This makes inefficient use of pins.

There are other disadvantages associated with the traditional LED dimming based on PWM dimming. To improve the dimming range of PWM dimming, a common solution is to push the PWM pulse width to reach a lowest level possible. However, when the PWM dimming pulse width is less than a threshold minimum pulse width, various problems may arise. Although such a threshold pulse width is often disclosed in a datasheet associated with a product, customers often exceed this lower minimum making the performance of the product unpredictable. For example, when the pulse width is lower than the specified minimum value, the output LED current and voltage may collapse completely. If this situation occurs, depending on the design, it sometimes requires the next pulse width to be extra long to jump start the circuit to bring back the output.

In addition, when power is turned on with PWM pulses having pulse width smaller than the specified minimum width, certain fault detection and protection features may not work due to the blanking time in some integrated circuits. Furthermore, when the pulse width is smaller than the minimum requirement, the actual peak LED current often will not reach the programmed level, failing to deliver the desired dimming effect. To make it worse, when PWM dimming is operating at a high temperature condition, due to leakage, the PWM dimming ratio often reduces so that the highest PWM dimming range as specified for the product can not be achieved without using lower leakage components. Therefore, a need exists to have an improved PWM dimming approach to solve those problems.

BRIEF DESCRIPTION OF THE DRAWINGS

The inventions claimed and/or described herein are further described in terms of exemplary embodiments. These exemplary embodiments are described in detail with reference to the drawings. These embodiments are non-limiting exemplary embodiments, in which like reference numerals represent similar structures throughout the several views of the drawings, and wherein:

FIG. 2(*b*) depicts a different embodiment of the present teaching where the input PWM signal is a differential signal, according to an embodiment of the present teaching;

FIG. 3 shows a table summarizing the dimming control configuration, according to an embodiment of the present teaching;

FIG. 5 shows some simulation results obtained when PWM LED dimming is combined with analog LED dimming in accordance with the present teaching.

DETAILED DESCRIPTION

The present teaching discloses method and apparatus for combining pulse width modulation (PWM) and analog LED dimming to improve the PWM dimming range in LED drivers. Specifically, when the width of a PWM signal reaches below a threshold level, the analog dimming approach is combined so that the dimming range is continuous and gradual.

An LED current generated for LED dimming usually has a width and amplitude, both of which have an effect on the LED dimming. As discussed in the background, the prior art solutions for PWM LED dimming have limited dimming range when the width of the PWM signal reaches a certain level. To overcome the deficiency of the prior art and to extend the dimming range, the present teaching combines PWM dimming with analog dimming as disclosed herein. To achieve that, a threshold pulse (TP) signal is used in conjunction with an input PWM signal. Such a TP signal has a width corresponding to a threshold width below which the conventional PWM dimming approach fails to operate properly. The purpose of utilizing such a TP signal is to ensure that an LED current can be continuously generated after the falling edge of the PWM signal has been detected with an amplitude determined based on a voltage charged while the PWM signal is high. In this way, even though the PWM signal has ended, the LED current will not be zero.

Figure 1:
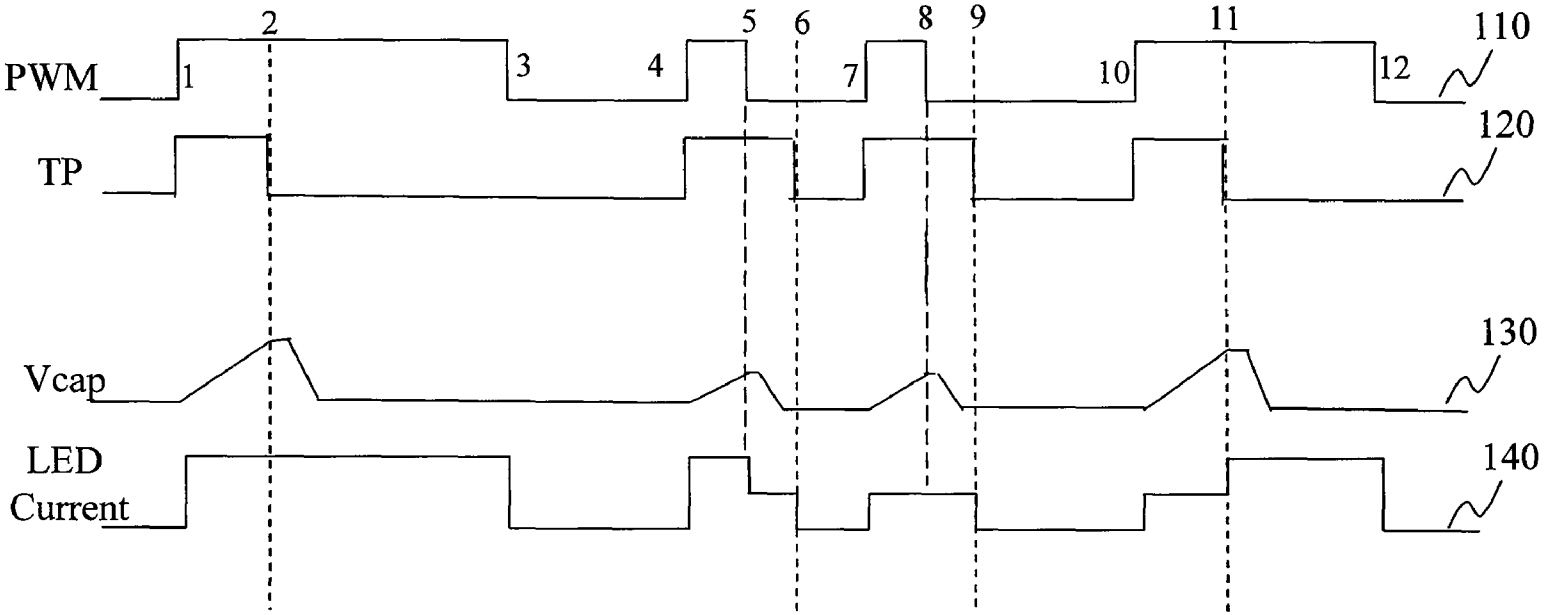
FIG. 1 illustrates exemplary timing diagrams in which PWM dimming and analog LED dimming are combined to extend the PWM dimming range, according to an embodiment of the present teaching.

This is illustrated in FIG. 1, where exemplary timing diagrams illustrate such relationships, according to an embodiment of the present invention. In FIG. 1, time diagram 110 represents a PWM signal, 120 represents the TP signal, 130 represents a voltage Vcap sampled at appropriate timings from a capacitor that is charged in the duration of the PWM signal, and 140 represents the LED current with width and amplitude adjusted in accordance with the present teaching based on the PWM signal, the TP signal, as well as the sampled voltage Vcap.

In the exemplary timing diagrams, there are different timing instances marked from 1, 2, 3, . . . , 12. At time instant 1, when the PWM signal goes high (rising edge), the TP signal is triggered to go high also. As mentioned above, the TP signal is generated with a configured width, representing a threshold width indicating that when the PWM signal has a width smaller than this threshold width, the analog dimming is activated to work in conjunction with the PWM dimming. In FIG. 1, the threshold width of the TP signal is the width measured between time instant 1 and time instant 2. From the timing diagrams shown in FIG. 1, it is illustrated that when the PWM width is larger than the threshold width, the PWM dimming works as it would conventionally and the LED current generated for dimming has the same width as that of the PWM signal. When the PWM signal has a width smaller than the threshold width, the LED current generated has the same width as that of the TP signal. For example, the LED current has a width between time instants 1 and 3, which is the same as that of the first pulse of the PWM signal. The LED current has a width between time instants 4 and 6, which is the same as that of the second pulse of the TP signal, even though the second pulse of the PWM signal has a width only between time instants 4 and 5. Similarly, the LED current has a width between time instants 7 and 9 when the PWM signal lasts only between time instants 7 and 8. The last LED current pulse again has the same width as that of the PWM signal because its width is larger than that of the TP signal.

Whenever the rising edge of the PWM signal is detected, the LED current is generated first using the same amplitude level as what is was set previously. For example, at time instant 1, the amplitude of the LED current is at a level that was set previously. So are the amplitude levels at time instants 4, 7, and 10. However, the amplitude level of the LED current does not necessarily remain at the same level. When the width of the PWM signal is not equal to that of the TP signal, at the first falling edge detected (either that of the PWM signal or of the TP signal, e.g., at time instants 5, 8, and 11), the amplitude level of the LED current is adjusted in accordance with the voltage at a charged capacitor Vcap (discussed below).

Such adjusted amplitude may or may not be equal to the original amplitude level of the LED current, depending on the voltage of Vcap. For instance, the amplitude level after time instant 5 (or after the adjustment) is lower than that before the adjustment at instant 5. The amplitude level after time instant 8 is the same as that before the adjustment at instant 8. The amplitude level after time instant 11 is higher than that before the adjustment at instant 11. Therefore, in accordance with the present teaching, the width the LED current is the larger of either the width of the PWM signal or that of the TP signal. The amplitude of the LED current is initially the previous set level or a level determined by the Vcap sampled at the time when the first falling edge of either the PWM or the TP signal is detected.

Figure 2A:
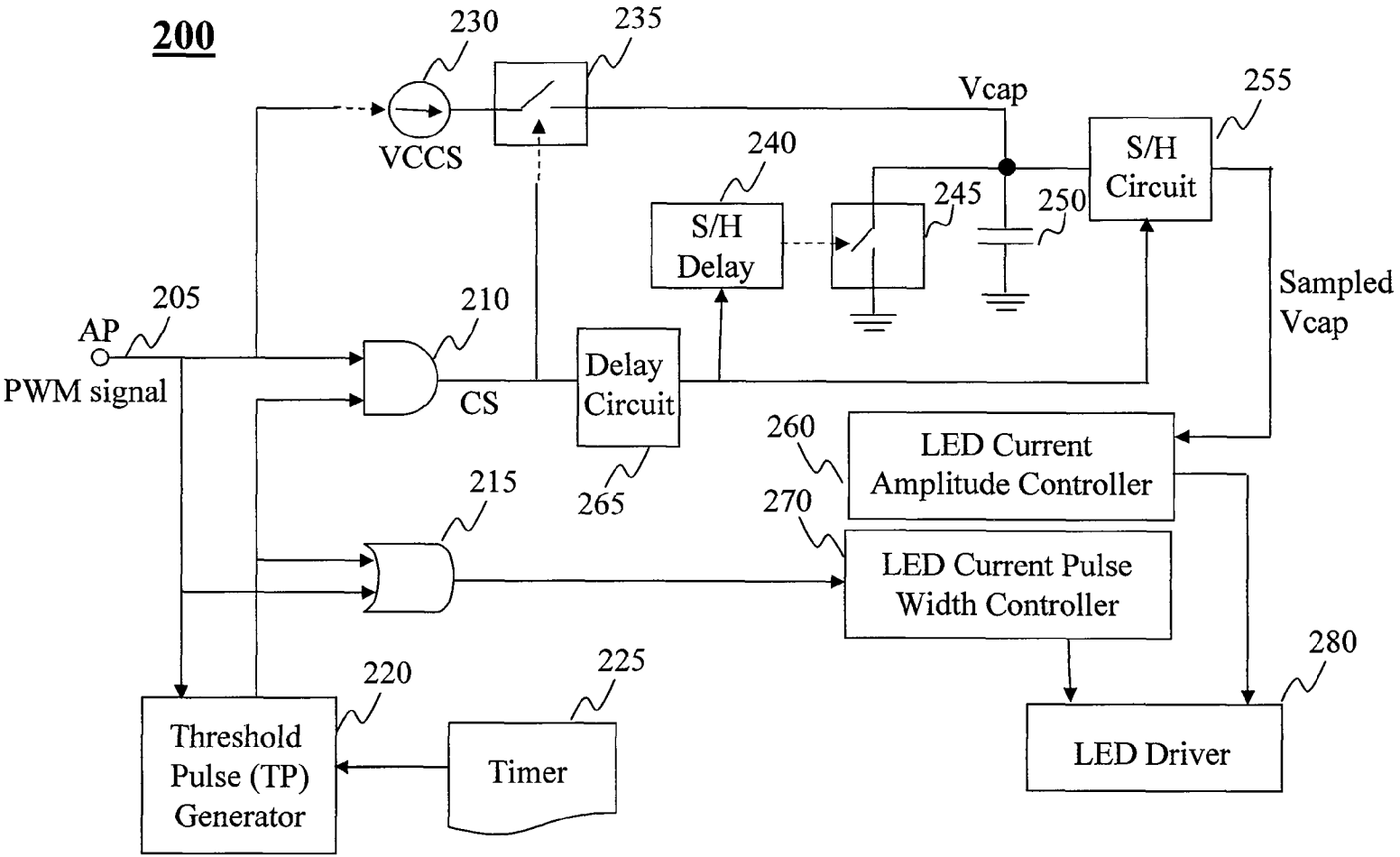
FIG. 2(*a*) depicts an exemplary circuit 200 that enables combining PWM with analog LED dimming to extend the PWM dimming range, according to an embodiment of the present teaching.
Figure 2B:
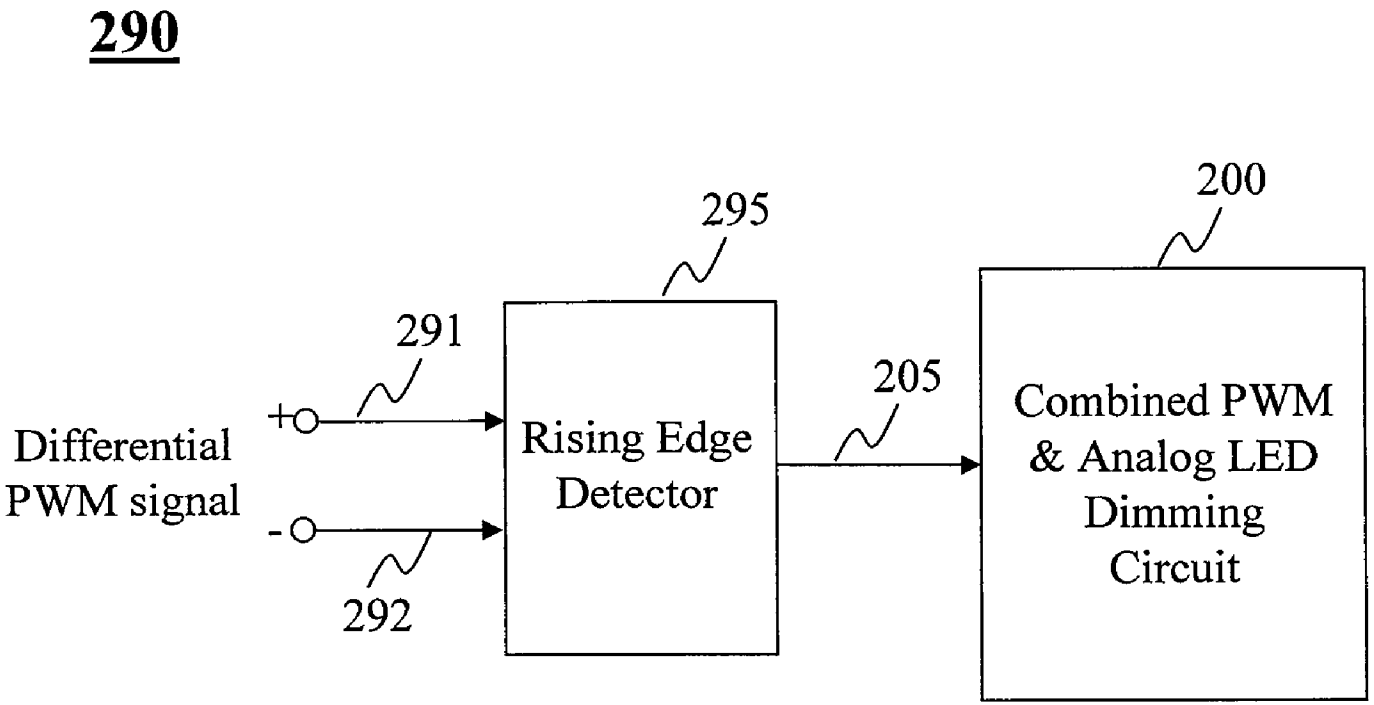

FIG. 2(*a*) depicts an exemplary circuit 200 that enables combining PWM with analog LED dimming to extend the PWM dimming range, according to an embodiment of the present teaching. Circuit 200 comprises an LED driver 280 that generates an LED current to control the dimming level of an LED light. The LED current generated by the LED driver 280 is controlled by the outputs of an LED current amplitude controller 260 and an LED current pulse width controller 270. The level of amplitude of the LED current is determined by either a previously set level, e.g., stored within the LED current amplitude controller 260 or retrieved elsewhere, or by the sampled voltage Vcap, which is obtained at an appropriate timing (e.g., at the detection of the first falling edge of either the PWM or TP signals). The sampling of the Vcap is performed by a sample/hold (S/H) circuit 255 by sampling the voltage charged on a capacitor 250.

As discussed above, the width of the LED current is determined by the larger width of that of the PWM or the TP signal. This larger width is detected by a dual falling edge detector 215 (e.g., it can be implemented using an OR gate whose output is low only when both inputs are low) which signals when both falling edges of the PWM signal and the TP signal are detected. In the illustrated embodiment, the TP signal is generated by a threshold pulse (TP) generator 220, which is activated by the rising edge of the PWM signal 205. The width of the TP signal is controlled by a timer 225, which can be configured to have a pre-determined value. In some embodiments, the timer 225 can be re-configured so that the circuit 200 can be deployed in different applications where different needs exist.

The capacitor 250 starts to be charged when both the rising edges of PWM signal and the TP signal are detected. This can be achieved via an AND gate 210, whose inputs are connected to the PWM signal and the TP signal and produces an output control signal that is to be used to control a switch 235. When the control signal from the AND gate 210 is high, the switch 235 is closed so that the current from a voltage controlled current source (VCCS) 230 charges capacitor 250. The level of the charging current is determined by the amplitude of the PWM signal. The charge current increases linearly from 0 to its maximum level when PWM amplitude is between Va and Vb, where Va is a voltage set to be higher than the threshold for the PWM rising edge detection. The LED current is zero when the PWM amplitude is less then Va. Vb is a voltage beyond which the PWM amplitude has no effort on the LED current. When either the PWM signal or the TP signal terminates, i.e., the falling edge is present, the output control signal of the AND gate 210 becomes low, and thereby opens the switch 235 so that the charging of the capacitor is terminated. Since the AND gate 210 changes its output state whenever the falling edge of either the PWM or the TP signal is detected, the AND gate 210 serves as a single falling edge detector.

The low state control signal from the AND gate 210 is also forwarded to a delay circuit 265, which may be configured to introduce a delay, determined based on, e.g., circuit characteristics or application needs, so that the output of the delay circuit is used to the control S/H circuit 255 as to the timing of sampling of Vcap. In general, the delay introduced by the delay circuit 265 is such that when the S/H circuit is permitted to sample Vcap, the voltage at the capacitor is stable and can be reliably sampled. Once the Vcap is sampled, it is fed to the LED current amplitude controller 260 so that the amplitude of the LED current can be adjusted accordingly. On the other hand, once the Vcap is sampled, the voltage on the capacitor 250 is discharged. This is achieved via a switch 245, which is connected to the ground for the discharge and controlled by a S/H delay circuit 240 as to timing. As illustrated, the output of the delay circuit 265 serves as an input to the S/H delay circuit 240, which introduces a further delay before it turns on the switch 245 to allow the capacitor to be discharged. In some embodiments, the delay introduced by the S/H delay circuit 240 is to ensure that the discharge will not occur until after the Vcap has been sampled.

As discussed, the initiation of the TP signal, the LED current, and the charging of the capacitor are based on the rising edge of the PWM signal. Therefore, the detection of the rising edge of the PWM signal may be crucial. In some embodiments, the precise location of the rising edge and/or the reliable detection of the existence of the rising edge may be crucial. It is well known in the art that differential signals are often used to facilitate reliable and precise detection of rising edges.

FIG. 2(*b*) depicts a different embodiment of the present teaching where the input PWM signal is a differential signal, according to an embodiment of the present teaching. In this illustrative circuit 290, differential PWM signals (+ signal 291 and – signal 292) are fed into a rising edge detector 295, which generates the signal 205 with rising edge detected and forwards it to the circuit 200 as an input. Then circuit 200 performs the functions of the present teaching as discussed herein. The rising edge detector 295 and the circuit 200 may or may not reside on the same integrated circuit. In some embodiments, circuit 200 may be an independent integrated circuit of a part thereof, which may provide a single pin for the input PWM signal. For example, when the PWM signal is not a differential signal, a single pin suffices to enable the combination of PWM and analog dimming. As another example, when the rising edge is detected outside of an integrated circuit where circuit 200 resides, one signal may also suffice to enable the present teaching as disclosed herein. In some embodiments, differential PWM signals 291 and 292 may be provided to an integrated circuit that incorporates circuit 290. In those applications, two pins may be provided to input the differential PWM signals.

FIG. 3 shows a table summarizing the dimming control configuration as discussed herein. The first column 310 of the table represents the discrete states of the PWM signal. The second column 320 represents the discrete states of the TP signal. The third column 330 represents the voltages used in different situations to achieve analog dimming control. As shown, when the states of both the PWM and the TP signal are high (first row 340), the voltage used for analog dimming control is a voltage level set previously (see time instants 1, 4, 7, and 10 in FIG. 1). When the falling edge of the TP signal is first detected while the state of the PWM signal is still high (row 350), the voltage used for analog dimming control is Vcap sampled after the falling edge of the TP signal is detected (see time instants 2 and 11). In this configuration, the width of the PWM signal is wider than that of the TP signal. When the falling edge of the PWM signal is first detected while the state of the TP signal remains high (row 360), the voltage used for analog dimming control is Vcap sampled after the falling edge of the PWM signal is detected (see time instants 5 and 8). In row 370, when the states of both the PWM and the TP signals are low (after both falling edges are detected), the analog dimming is terminated (see time instants 3, 6, 9, and 12).

Figure 4:
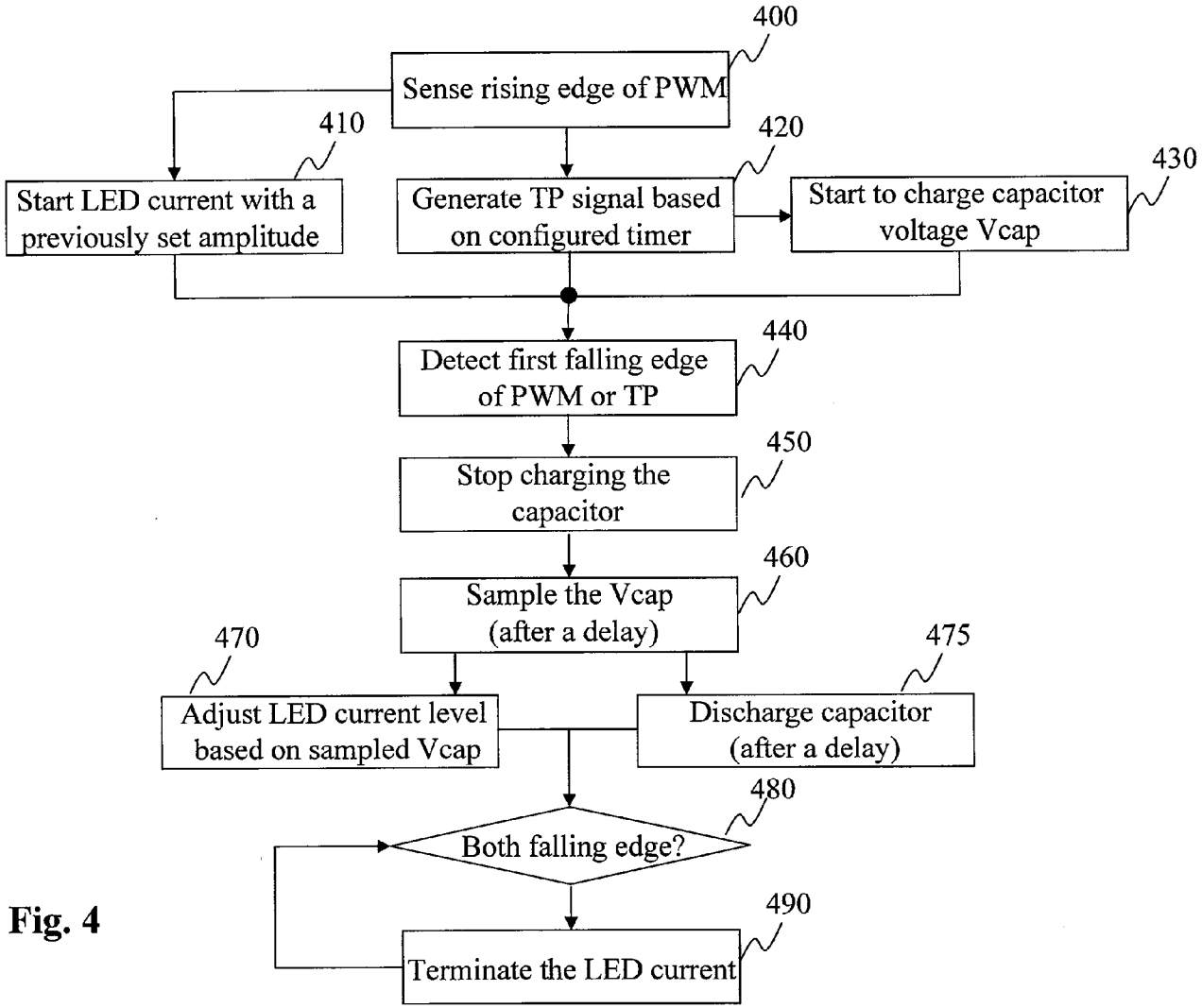
FIG. 4 is a flowchart of an exemplary process in which PWM and analog LED dimming are combined to extend PWM dimming range according to an embodiment of the present teaching.

FIG. 4 is a flowchart of an exemplary process in which PWM and analog LED dimming are combined to extend PWM dimming range according to an embodiment of the present teaching. The rising edge of the PWM signal is first sensed at 400. Upon the detection of the rising edge of the PWM signal, the LED current is generated, at 410, with a previously set amplitude level. In addition, the TP signal is generated, at 420, in accordance with the configured timer that controls the width of the TP signal. Furthermore, the circuit 200 or 290 starts to charge, at 430, the capacitor 250. The above three operations keep going until the first falling edge, either from the PWM signal or from the TP signal, is detected at 440.

Once the first falling edge is detected, the charging of the capacitor is stopped, at 450, and the voltage on the capacitor, Vcap, is sampled, at 460, after, e.g., a configured delay period. Such sampled Vcap is then used to adjust, at 470, the amplitude of the LED current. In addition, after the sampling, the voltage on the capacitor is discharged, at 475 (e.g., with another delay). When both falling edges are detected, at 480, the LED current is terminated at 490.

FIG. 5 shows some simulation results obtained when PWM LED dimming is combined with analog LED dimming in accordance with the present teaching. As can be seen in FIG. 5, the width of the LED current is the larger width of the width of the PWM signal and the width of the TP signal. For example, in the first three rows (540, 545, 550), although the amplitude of the PWM signal remains the same, due to the difference in its width, the amplitude of the LED current differs. The smaller the width of the PWM signal, the smaller the amplitude of the LED current. This is due to the fact that as soon as the falling edge of the PWM signal is detected, the capacitor is no longer being charged so that the shorter the charging time, the lower the Vcap is and hence, the lower the LED current amplitude.

FIG. 5 also shows that the amplitude of the PWM signal also has an impact on the amplitude of the LED current. The LED current increases linearly from 0 to the maximum level when the PWM amplitude increases from Va to Vb, as discussed herein. In this example, Va is set to 1V. Vb is set to 2V. The LED current is not affected by the PWM amplitude higher than Vb. This is evidenced in the simulation result in rows 540 and 555. While in both testing cases, the width of the PWM signal remains the same (30 μs), the amplitudes differ (in row 540, it is 2.5 v while in row 555, it is 1.5 v). The simulation result shows that the higher the amplitude of the PWM signal, the higher the amplitude of the LED current. This is due to the fact that when the amplitude of the PWM signal is higher, the higher the current VCCS used to charge the capacitor 250. Consequently, this yields a higher Vcap, which leads to a higher LED current amplitude.

As can be seen from the discussion herein, both the pulse width of the PWM and its amplitude (between Va and Vb) affect the dimming level. When the width of the PWM signal is larger than that of the TP signal, the dimming is controlled by the PWM. In this case, the amplitude of the LED current is determined by the amplitude of the PWM signal because such an amplitude level is used to charge the capacitor and affect the amplitude of Vcap, which ultimately determines the amplitude of the LED current. When the width of the PWM signal is smaller than that of the TP signal, the LED current does not terminate with the falling edge of the PWM signal but the charging of the capacitor does terminate with the falling edge of the PWM signal. In this situation, the LED current will keep going but with an adjusted amplitude determined based on the sampled Vcap and, hence, achieving analog dimming when PWM dimming cease to operate well. In addition, the amplitude level as set in a previous cycle affects the initial amplitude of the next cycle as shown in FIG. 1. However, such an initial amplitude level is to be adjusted depending on the relationship between the PWM and TP signals in the next cycle.

The present teaching as discussed herein allows integrated PWM and analog dimming and combining both by sharing pin(s). In the case where a non-differential PWM signal is provided, a single pin is used for combined PWM and analog dimming. When differential PWM signals are used, the PWM dimming and analog dimming can shared two pins, through which differential PWM input signals are provided. In the disclosure herein, the peak LED current level is determined by the amplitude sensed on the PWM input pin and at the same time, the peak LED current level is also determined by the PWM pulse width when the pulse width is narrower than that of the TP signal. Here, the TP signal width can be configured to meet different application requirements. The light output decreases as the PWM pulse width is reduced to a minimum desirable level, even though such a level is below the operable level of the PWM dimming, the light output will continue based on the analog dimming and thereby extend the dimming range.

While the inventions have been described with reference to the certain illustrated embodiments, the words that have been used herein are words of description, rather than words of limitation. Changes may be made, within the purview of the appended claims, without departing from the scope and spirit of the invention in its aspects. Although the inventions have been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the appended claims.

We claim:

1. A method for driving a light emitting diode (LED), comprising:

sensing a rising edge of a pulse width modulation (PWM) signal, wherein, upon sensing the rising edge, initiating a threshold pulse (TP) signal having a configured width started when the rising edge is sensed, generating an LED current with an amplitude at a previously set level, and starting to charge a capacitor which yields a voltage Vcap;

detecting a falling edge of either the PWM signal or the TP signal, wherein upon detecting the failing edge, stopping charging the capacitor, sampling, after a first delay from the detecting the falling edge, the voltage Vcap, adjusting a level of the amplitude of the LED current based on the sampled voltage Vcap; and terminating the LED current when it is detected that both the PWM signal and the TP signal reach a low state.

2. The method of claim 1, wherein the PWM signal is a differential signal.

3. The method of claim 1, wherein the configured width is controlled by a timer.

4. The method of claim 3, wherein the timer is re-configurable to adjust the width of the TP pulse.

5. The method of claim 1, further comprising discharging the capacitor after the first and a second delay.

6. The method of claim 1, wherein the first delay is determined so that the voltage Vcap is sampled after the charging of the capacitor is stopped.

7. The method of claim 1, wherein the second delay is determined so that the voltage Vcap is not discharged until after the capacitor is sampled.

8. An apparatus for driving a light emitting diode (LED), comprising:

a capacitor configured to be charged to yield a voltage Vcap when a rising edge of a pulse width modulated (PWM) signal is detected;

a threshold pulse (TP) generator, connecting to the PWM signal, configured to generate a TP signal having a configured width started when the rising edge of the PWM signal is detected, an LED driver configured for generating an LED current with an amplitude at a previously set level when the rising edge of the PWM signal is detected;

a single falling edge detector configured for detecting a falling edge of either the PWM signal or the TP signal and producing a first control signal, upon the detection of the falling edge, that is used to stop charging the capacitor;

a voltage sampling circuit configured for sampling, after a first delay upon the falling edge of either the PWM or TP signal is detected, the voltage Vcap so that the sampled voltage Vcap is used to adjust the amplitude of the LED current;

a dual falling edge detector configured for detecting that both the PWM signal and the TP signal reach a low state and terminating the LED current upon the detection of the low state of both the PWM and the TP signals.

9. The apparatus of claim 8, wherein the PWM signal is a differential signal.

10. The apparatus of claim 8, further comprising a timer which is used to control the configured width used by the TP generator.

11. The apparatus of claim 10, wherein the timer is re-configurable to adjust the configured width of the TP pulse.

12. The apparatus of claim 8, further comprising a switch having its switch-on control connected to the PWM signal and its switch-off control connected to the first control signal so that on the rising edge of the PWM signal, the first switch is switched on to allow the charge of the capacitor, on the falling edge of either the PWM or the TP signal, the first switch is switched off, stopping the charge of the capacitor.

13. The apparatus of claim 8, further comprising a delay circuit having its input coupled to the first control signal and configured to generate a second control signal that is delayed from the first control signal for the first delay.

14. The apparatus of claim 13, further comprising a hold circuit having its input coupled to the second control signal and configured to generate a third control signal that is delayed from the second control signal for a second delay, wherein the third control signal is used to control the timing of discharging the capacitor.

15. The apparatus of claim 14, wherein the first delay is determined so that the voltage Vcap is sampled after the charging of the capacitor is stopped.

16. The apparatus of claim 14, wherein the second delay is determined so that the voltage Vcap is not discharged until after the capacitor is sampled.

17. The apparatus of claim 8, further comprising an LED current amplitude controller having its input coupled to the sampled Vcap and configured to generate a fourth control signal that is used by the LED driver to adjust the amplitude of the LED current.

18. The apparatus of claim 8, further comprising an LED current pulse width controller having its input coupled to the dual falling edge detector and configured to generate a fifth control signal that is used by the LED driver to control the width of the LED current.

* * * * *